United States Patent [19]

Fultz, Jr et al.

[11] Patent Number: 4,518,366

[45] Date of Patent: May 21, 1985

[54] MANIPULABLE DOLL

[76] Inventors: Carl Fultz, Jr; Phyllis D. W. Fultz, both of 315 Summerwood Dr., Bristol, Tenn. 37620

[21] Appl. No.: 475,856

[22] Filed: Mar. 16, 1983

[51] Int. Cl.[3] ..... A63J 19/00; A63H 3/20

[52] U.S. Cl. ..... 446/366; 446/360; 446/330

[58] Field of Search ..... 46/119, 120, 121, 126, 46/136, 137, 138, 151, 158; 446/330, 359, 360, 361, 362, 363, 366, 369

[56] References Cited

U.S. PATENT DOCUMENTS

| | | | |
|---|---|---|---|
| 845,985 | 3/1907 | Thornton | 46/137 |
| 2,137,575 | 11/1938 | Lincoln | 46/137 |
| 2,509,135 | 5/1950 | Coplan | 46/126 |
| 2,657,499 | 11/1953 | Rollins | 46/126 |
| 3,898,764 | 8/1975 | Palmer | 46/126 |
| 3,990,178 | 11/1976 | Stephens | 46/137 |

FOREIGN PATENT DOCUMENTS

| | | | |
|---|---|---|---|
| 747340 | 6/1933 | France | 46/137 |

*Primary Examiner*—Robert A. Hafer
*Assistant Examiner*—Daniel Nolan
*Attorney, Agent, or Firm*—Pitts and Brittian

[57] ABSTRACT

An improved manipulable doll (10) for reproducing lifelike movement while operated by a human operator (12) on a rhythm board. The doll (10) includes a torso member (18), and a head portion (26) fixedly engaged to the upper end portion of the torso member (18). An outer covering (30) serves to give the doll (10) the desired appearance. The outer covering (30) comprises a pair of arm portions (34) and a pair of leg portions (40). A pair of hand members (38) are fixed engaged to each arm portion (34), and a pair of foot members (44) are fixedly engaged to leg portions (40). The invention further provides for a manipulator rod (14) and a support board (16) for manipulating the doll (10) during operation to simulate a dancer.

8 Claims, 5 Drawing Figures

MANIPULABLE DOLL

DESCRIPTION

1. Technical Field

The field of this invention is generally manipulable dolls or puppets and more particularly an improved manipulable doll capable of reproducing or mimicking lifelike movement when operated by a human operator.

2. Background Art

Dolls or puppets fashioned to produce or mimic lifelike movement have been popular throughout history, and those in the art have devised complicated and expensive mechanisms for reproducing such lifelike qualities in their dolls. However, past attempts at fabricating lifelike manipulable dolls have centered around mimicry of skeletal elements and muscular elements such as providing rigid members to serve as bone structures and providing pivoting or hinged joints to duplicate the joints of a living creature. Thus, the truest reproduction of lifelike movement has been achieved by the most complex and most expensive of dolls.

Accordingly, it is one object of the present invention to provide a manipulable doll capable of mimicking or reproducing lifelike movement when operated by a human operator on a rhythm board.

It is another object of the present invention to provide a manipulable doll which reproduces lifelike movement and which can be easily and inexpensively manufactured.

It is another object of the present invention to provide a manipulable doll capable of preforming dance movements when operated by a human operator on a rhythm board.

It is still another object of the invention to provide a manipulable doll capable of producing rhythmic sounds and movements as it is operated as an accompaniment to a musical composition.

Further objects of the invention will become apparent upon a consideration of the drawings and the description hereinafter.

DISCLOSURE OF THE INVENTION

In accordance with the present invention, an improved manipulable doll for reproducing lifelike movement while being operated by a human operator is provided. The doll comprises in a preferred embodiment a torso member provided with a centrally located annular recess, and a head portion fixedly engaged to the upper end portion of the torso member. An outer covering is provided to give the doll the desired appearance, the outer covering comprising a pair of arm portions and a pair of leg portions. A hand member is fixedly attached to each arm portion and a foot member is attached to each leg portion to complete the lifelike appearance of the doll. The invention provides for a manipulator rod or dowel in the preferred embodiment having a first end portion received in the recess of the torso member, and a second end portion which is grasped by the operator in order to manipulate and support the torso of the doll as it is operated. Further, a support or rhythm board is provided for flexibly supporting and vibrating the doll as it is operated by the operator. In operating the doll the operator sits upon the first end portion of the support board while using the manipulator rod to hold the doll erect such that the foot members rest upon the second end portion of the support board. Then by manipulating the torso with the manipulator rod with one hand, and vibrating as by depressing and releasing the support board with the other hand, the operator may produce dance movements and other lifelike movements in the doll, while at the same time a rhythmic tapping is produced through the striking of the pivotal foot members on the support board.

BEST MODE FOR CARRYING OUT THE INVENTION

Figure 1:
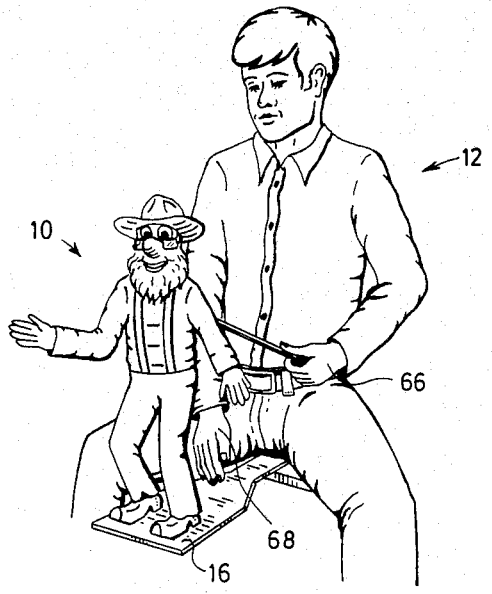
FIG. 1 is a perspective drawing illustrating one preferred embodiment of the improved doll of the present invention as it is operated by a human operator on a typical rhythm board.
Figure 2:
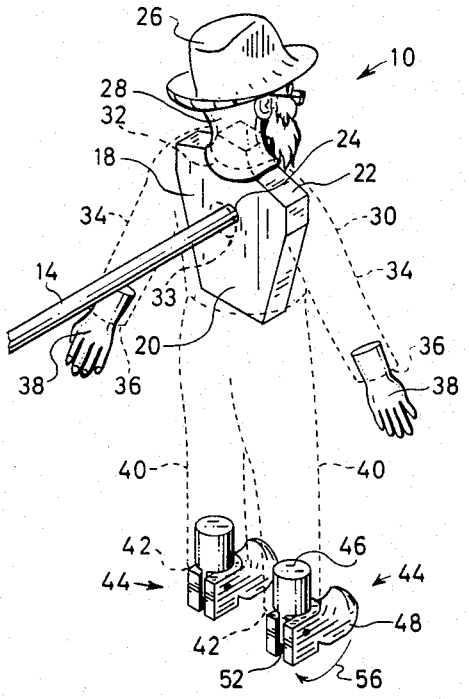
FIG. 2 is a perspective drawing of the doll of the present invention.

Referring now to the figures, a manipulable doll incorporating various features of the present invention is illustrated generally at 10 of FIGS. 1 and 2. As can be seen in FIG. 1, the doll 10 is operated by a human operator 12 by manipulation of a manipulator rod 14 and a flexible support or rhythm board 16. In FIGS. 1 and 2 the doll 10 assumes the appearance of an older human male; however, as will be discussed below the doll can assume various other appearances with minor variations in facial features and apparel, which functions as the skeleton to give the doll its lifelike motion and rhythm when operated on the rhythm board 16.

As is best illustrated in FIG. 2, the doll 10 comprises a torso member 18 having a lower waist portion 20 corresponding, in this embodiment, to a human waist, and an upper end portion 22 corresponding to the shoulder area of a human figure. In the embodiment of FIG. 2 the torso 18 is tapered such that the lower portion 20 is narrower than upper portion 22, thus simulating the male torso. However, it will be appreciated that the torso 18 can assume various shapes given the desired human or animal shape to be represented. The torso member 18 is further provided with a recess 24 which is annular in the illustrated embodiment for slidably receiving rod 14. The torso member 18 is most desirably fabricated of wood or plastic but other light durable materials can be used.

A head portion 26 is provided which carries an intergrally formed neck portion 28. Neck portion 28 fixedly engages upper end portion 22 of torso member 18 and is fastened by an adhesive, sewing, or other suitable fastening means.

The torso member 18 is draped with an outer covering 30 (represented by broken lines in FIG. 2) fabricated of cloth or other thin fexible material, in the embodiment of FIGS. 1 and 2, giving the appearance of the outer garments of a human figure, including a shirt and pants, for example. The outer covering 30 is provided with an opening 32 through which neck portion 28 protrudes, and, whereas the outer covering 30 encloses the torso member 18, it is not necessarily fixedly engaged to the torso member 18 at any given point. This draping effect of the outer covering 30 over the torso member 18 enhances the lifelike qualities of the doll 10 as it is operated on the rhythm board. The outer covering 30 is also provided with an opening 33 for receiving rod 14 such that it may be received in annular recess 24.

In the embodiment of FIG. 2 the outer covering 30 comprises a pair of arm portions 34 terminating in sleeve openings 36. A pair of hand members 38 are provided and are received in the openings 36 and fixedly engaged to the arm portions 34 by an adhesive, sewing or other suitable fastening means. The hand members 38 can be fabricated of wood, plastic, or other durable material; however, for proper operation, it is necessary that the hand members 38 be of sufficient weight that as the doll is operated the weight of the hand members 38 coupled with the movement of the doll overcomes any resistance to flexibility inherent in the material used to fabricate the outer covering 30, and more specifically the arm portions 34.

Figure 3:
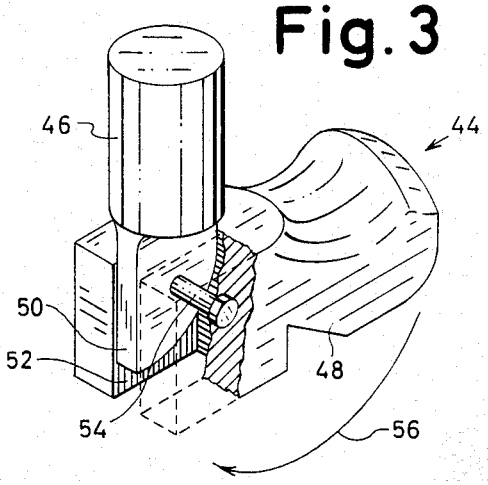
FIG. 3 is a perspective drawing, partially in section, illustrating a preferred embodiment of a foot member.

As is illustrated by broken lines in FIG. 2, the outer covering 30 further comprises a pair of leg portions 40 terminating in a pair of leg openings 42. A pair of corresponding pivoting foot members 40 are provided, each foot member 40 comprising a stem member 46 and a shoe member 48, each stem member 46 being received in the corresponding opening 42 and secured by adhesive, sewing or other suitable fastening means. As is best illustrated in FIG. 3, the stem member 46 is provided with a flange member 50 which is pivotally received in a slot 52 in shoe member 48 and pivotally secured with pivot pin 54 such that shoe member 48 pivots with respect to stem member 46 as indicated by arrow 56. The foot member 44 can be fabricated of wood, plastic or other durable material. However, for proper operations it is necessary that the foot members 44 be of sufficient weight that as the doll is operated the weight of the foot members 44 coupled with the movement of the doll overcomes any resistance to flexiblity inherent in the material used to fabricated the outer covering 30, and more specifically the leg portions 40.

Figure 4:
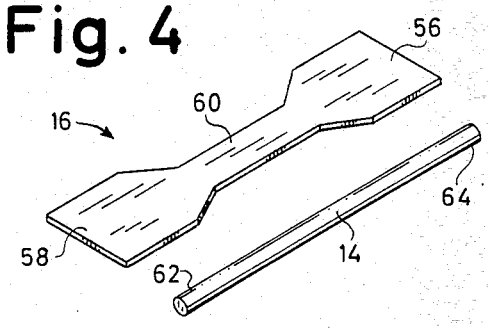
FIG. 4 is a perspective view of the support board and manipulator rod of the present invention.

The support or rhythm board 16 serves as the stage or platform upon which the doll 10 is operated, and in the embodiment of FIG. 4 board 16 comprises a thin board having a first end portion 56 on which the operator sits in order to releasably secure the board 16 in place, and a second end portion 58 which serves as the operating surface of the doll 10. The board 16 is most desirably fabricated of wood, however, various other flexible, resilient materials can be used. In this embodiment the board 16 includes a waisted mid-section 60 having a decreased width relative to end portions 56 and 58. This decrease in width increases the flexibility of the board 16 and enhances the operators ability to cause the second end portion 58 to vibrate. Also illustrated in FIG. 4 is the manipulator rod 14 comprising a first end portion 62 for insertion in annular recess 24, and a second end portion 64 which is held by the operator 12, thus allowing the operator to directly control the motion of the torso member 18 and indirectly the motion of the doll 10 as a whole.

The operator 12 operates the doll 10 by sitting upon the first end portion 56 of board 16 such that second end portion 58 extends before the operator 12. The first end portion 62 of rod 14 is inserted in annular recess 24 of torso member 18 such that by grasping second end portion 64 of rod 14 with a first hand 66, as illustrated in FIG. 1, the operator can control the doll's position and cause the doll to stand erect with the shoe members 48 resting on the board 16. Thus positioned, the operator 12 can simultaneously move the torso 18 with rod 14, and strike the board 16 with a second hand 68 causing the board 16 to vibrate, in turn causing the shoe members 48 bounce upon the board 16 in a lifelike manner. The resulting movement of the torso member 18, and shoe members 48, is consequentially transmitted to the outer covering 30 producing lifelike movement in the doll 10.

As discussed above, the past practice in the art has been to copy the rigid skeletal structure of the living creature being produced when fabricating a manipulable doll, the rationale being that structural mimicry will produce accurate reproduction of the actual living movement. However, such structure mimicry has seldom produced an accurate reproduction of movement due to the complexity of movement inherent in most living creatures. In fact, through experimentation, it has been discovered that the lack of rigid structure in the arm portions 34 and the leg portions 40 of outer covering 30 of the present invention actually improved the lifelike appearance of the doll 10 as it is operated. The movement of the doll through manipulation by manipulator rod 14 and vibration of support board 16 is translated into lifelike movement in the outer covering 30 as a whole, including a bias toward bending in places where joints would naturally occur in the living form.

The doll 10 is particularly adaptable to reproducing dance type movements, and perhaps most adaptable to simulating movements of a dance commonly known as "clogging". In reproducing these dance movements with the doll 10 the appropriate music is played and the operator 12 strikes the board 16 in time with the music causing the shoe members 48 to bounce and vibrate in time with the music giving the appearance that the doll 10 is dancing to the music and producing a rhythmic tapping reminiscent of a dancer's feet striking the dance floor. The lifelike appearance of the doll can be enhanced by the calculated movement of the torso member 18 causing movement in the arm portions 34 and the outer covering 30 as a whole.

Figure 5:
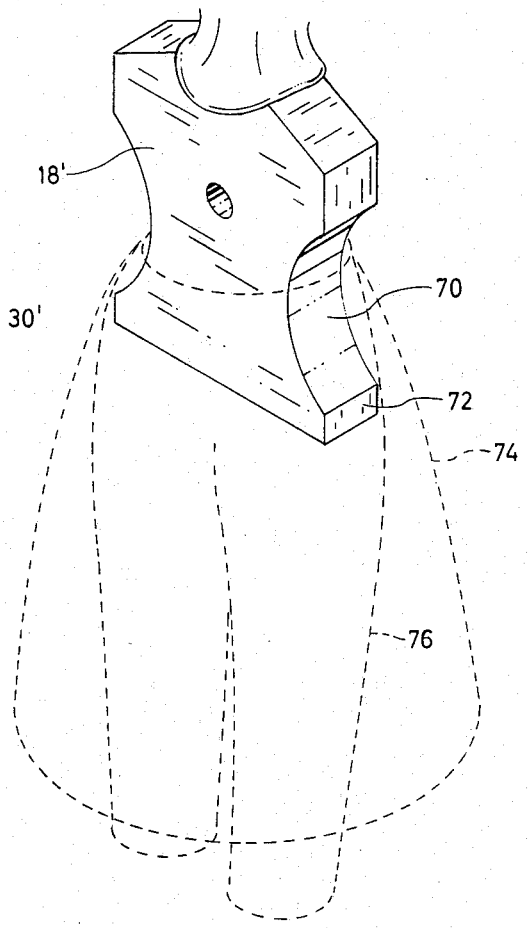
FIG. 5 is a perspective view of an alternate embodiment of the torso member and outer covering of the present invention.

As alluded to above, the doll 10 can assume various appearances with minor variations in the outer covering 30 and in the features of the head portion 26. It should be appreciated that the outward appearance need not be that of a human figure and that the doll may take on the appearance of various animal figures. However, such adaptions or variations in appearance may necessitate variations in the shape of the torso member 18. For example, in the embodiment of FIG. 5, the torso member 18' is provided with a waisted mid-section 70 and a relatively wider hip portion 72 such that the outer covering 30' can comprise a skirt 74 secured about, although not necessarily engaged to, the mid-section 70 with the wider hip portion 72 serving to hold the skirt 74 in position. The outer covering 30' further comprises bloomers 76 which engage foot members 44 (not shown). Thus, the doll 10 is given a female appearance rather than the male appearance of FIGS. 1 and 2.

While a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. An improved manipulable doll for reproducing lifelike human or animal movement while being operated by a human operator, said doll comprising:

a torso member having a lower waist portion and an upper end portion, and provided with a centrally located annular recess oriented substantially perpendicular to a line joining said waist portion and said upper end portion of said torso member;

a head portion including an integrally formed neck portion, said neck portion being centrally located on and fixedly engaged to said upper end portion of said torso member;

a universally flexible connecting medium for enclosing said torso member and giving said doll lifelike appearance, said connecting medium being provided with a first opening for receiving said neck portion of said torso member and a second opening corresponding to said annular recess of said torso member, said connecting medium further comprising a pair of arm portions, each said arm portion having a free end portion, and a pair of leg portions, each said leg portion having a free end portion;

a pair of hand members, each said hand member being fixedly engaged to said free end portion of said arm portion of said connecting medium, said connecting medium functioning as sole connection between said hand members and said torso member;

a pair of foot members, each said foot member being fixedly engaged to said free end portion of each said leg portion of said connecting medium, said connecting medium functioning as sole connection between said foot members and said torso member;

a manipulator rod having a first end portion being slidably received through said second opening in said connecting medium and releasably received in said annular recess of said torso member, and a second end portion for being grasped by said operator in operating said doll; and a support board for flexibly supporting and vibrating said doll as it is operated by said operator.

2. The doll of claim 1 wherein said torso member further comprises a waisted mid-section and a lower hip portion, said hip portion having a relatively greater width than said waisted mid-section, whereby said leg portions of said connecting medium are constructed as pantalloons and wherein said connecting medium further comprises a skirt overlying said pantaloons for giving said doll the appearance of a female figure, said skirt being closely received about said mid-section of said torso and held in position by said lower hip portion of said torso member.

3. The doll of claim 1 wherein each said arm portion of said connecting medium is provided with a sleeve opening proximate said free end portion of said arm portion and wherein said hand members are received in said sleeve openings and fixedly engaged to said arm portions of said connecting medium.

4. The doll of claim 1 wherein each said leg portion of said connecting medium is provided with a leg opening proximate said free end portion of said leg portion and wherein each said foot member is provided with a stem member to be received in said leg openings and fixedly engaged to said leg portions of said connecting medium.

5. The doll of claim 4 wherein each said foot member further comprises a shoe member pivotally engaged to said stem member of said foot member with a pivot member.

6. The doll of claim 5 wherein said shoe member comprises a toe portion and a heel portion and is provided with a slot proximate said heel portion, and said stem member is provided with a flange member for being received in said slot and pivotally secured with said pivot member, and wherein said stem member extends from said pivot member a distance substantially equal to the distance said shoe member extends toward said toe portion from said pivot member.

7. The doll of claim 1 wherein said support board further comprises a first end portion upon which said operator sits and secures said support board in place for operation, and a second end portion for supporting and vibrating said doll as it is operated by said operator, and wherein said support board is provided with a waisted middle portion having a decreased width relative to said first and second end portions of said support board for enhancing the flexibility of said support board.

8. The doll of claim 1 wherein said torso member comprises a waist portion corresponding to a human waist and an upper portion corresponding to the shoulder area of a human figure, and wherein said leg portions of said connecting medium are constructed as a pair of pants to give said doll the appearance of a male figure.

* * * * *